United States Patent [19]

Daoud

[11] Patent Number: 4,474,502

[45] Date of Patent: Oct. 2, 1984

[54] WATER SPORTING BOAT

[76] Inventor: Mohamed Daoud, 10429 Sacré Coeur, Montreal, Quebec, Canada, H2C 2S8

[21] Appl. No.: 499,408

[22] Filed: May 31, 1983

[51] Int. Cl.[3] ..... B63H 16/12

[52] U.S. Cl. ..... 440/29

[58] Field of Search ..... 440/21-32; 441/74

[56] References Cited

U.S. PATENT DOCUMENTS

| | | | |
|---|---|---|---|
| 956,533 | 5/1910 | Krause | 440/30 |
| 1,244,073 | 10/1917 | Pavese | 440/30 |
| 1,578,395 | 3/1926 | Chapin | 440/31 |

FOREIGN PATENT DOCUMENTS

| | | | |
|---|---|---|---|
| 24624 | 10/1901 | Switzerland | 440/30 |

*Primary Examiner*—Trygve M. Blix
*Assistant Examiner*—Jesûs D. Sotelo
*Attorney, Agent, or Firm*—Robic, Robic & Associates

[57] ABSTRACT

Water sporting boat of the pedal type comprising a surfboard having a hollow keel at the stern into which is provided a mechanical transmission connected to one end of a rotary shaft, a propeller being mounted at the other end of the shaft, outside the hollow keel. Pedal power is transferred to the mechanical transmission by a chain drive also connected to a pedalling rack fixed on the surface of the surfboard. A steering rack, provided forwardly of the pedalling rack, is connected to a rudder, at the stern of the surfboard, by a cable transmission. The steering rack includes a handle bar and the cable transmission is connected to the rudder so that the latter responds to the same steering direction as that applied by the handle bar.

14 Claims, 4 Drawing Figures

WATER SPORTING BOAT

The present invention relates to a water sporting boat of the pedal type.

The following patents are known to relate to water sporting boats in general:

Canadian Patents

No. 209,632 of 1921
No. 272,049 of 1927
No. 276,579 of 1927
No. 308,955 of 1931
No. 327,048 of 1932
No. 492,547 of 1953
No. 604,144 of 1960
No. 753,066 of 1967
No. 891,811 of 1972
No. 912,923 of 1972
No. 1,039,122 of 1978

U.S. Patents

U.S. Pat. No. 577,269 of 1897
U.S. Pat. No. 1,578,395 of 1926
U.S. Pat. No. 2,663,278 of 1953

Possibly, the only reference of interest in the above list, with respect to the present invention, is U.S. Pat. No. 1,578,395. The latter discloses a water bicycle having a generally flat elongated pontoon on a top surface of which is provided a pedalling mechanism while balancing and steering means project from the lower surface. In one instance, this balancing means includes a rigid keel at the rear end of the pontoon while steering is achieved by a guiding rudder which is also intended to provide some balancing effect and, in order to be efficient, is disposed below the rear keel. This necessitates extending the handle bar column, as well as the handle bar post that extends through it, to project an appreciable distance from the bottom surface of the pontoon. Because of this distance, appropriate bracketing has to be foreseen, again beneath the pontoon, to suitably brace the guiding or steering rudder.

In another form, steering rudders are provided both at the bow end and stern end on the pontoon while balancing planes extend laterally on either side of the pontoon for providing additional balancing effect.

In both cases, the whole construction is bulky and cumbersome so that it is truly unsuitable for a boat intended mostly for sporting and where power is derived from leg action which is of course limited and, hence, the importance of having a construction which is quite streamlined and devoid, as much as possible, of parts that project laterally or beneath the pontoon that could hinder its displacement. Another very important aspect of nowadays sporting boat of this type is its ease in moving it about and particularly loading it on either the top of a car or a trailer and, for this purpose, the boat should be provided with no part projecting from the floating surface, that is the bottom surface.

It is therefore an important object of the present invention to avoid the above-described drawbacks and provide the advantageous feature useful in transportation of the sporting boat. More specifically, the water sporting boat according to the invention allies the slenderness, thinness and lightweight of a surfboat and an especially adapted foot-operated propelling mechanism that allows retaining the above particularly advantageous features of the surfboat while avoiding that any parts project from the lower surface of the surfboard so that the boat may easily be carried about when out of water. It further makes it possible, when riding on water, to retain the speed characteristic of the surfboard.

By surfboard, in the present specification, is to be understood an elongated light body made, for instance, of foamed thermoplastic material, such as expanded polystyrene, coated with fiberglass-reinforced plastic material. Such a body is quite sturdy although thin with respect to its length, the latter being about three times or more its greatest width and being somewhat longer than human body length. As to its thickness, it is about 16 times smaller than the length. Variations in the dimensions are of course possible, it being kept in mind that a surfboat is a very slender floatable body.

Accordingly, the invention is herein broadly claimed as a water sporting boat of the pedal type, comprising:

a surfboard in the form of an elongated thin body having top and bottom surfaces interconnected by side surfaces, said surfaces terminating at one end of said body to form a bow and terminating, at the other end of said body, into a stern; a keel projecting from said bottom surface and removably mounted on said body; wherein said keel has a vertical end wall located short of said stern transversely of said body, and further has confining outer walls tapering forwardly from said end wall and smoothly merging with said body beneath said top surface; said keel being hollowed out to define a keel chamber; a passage opening into said chamber and onto said body top surface; a rudder supporting ledge integral with said keel, projecting perpendicularly from the lower edge of said keel end wall in the direction of said stern; an elongated slot formed through said body, intermediate said bow and stern, and a fin removably and snugly passing across said slot from said body top surface and extending away from said body bottom surface sufficiently to ensure stability to said surfboard, in use thereof;

a propelling mechanism comprising: a rotary shaft mounted across said keel end wall, having one end inside said keel chamber and one end outside thereof; a propeller mounted on said outside end; a sitting rack secured to the top surface of said surfboard body and having a seat for a user at the top thereof; a pedalling mechanism mounted on said sitting rack and including a chain drive extending through said body passage and into said keel chamber, and a mechanical transmission in said chamber, operatively joining said chain drive and said rotary shaft, whereby operation of said pedalling mechanism causes rotation of said propeller for displacement of said surfboard;

a steering mechanism comprising: an essentially flat rudder having a rear vertical edge and mounted on said rudder supporting ledge and on said body stern for swinging movement about a vertical axis extending across the free end of said ledge, across said stern and along said rudder rear edge, rearwardly of said propeller; a steering rack secured to the top surface of said surfboard body, forwardly of said sitting rack, and including a steering member secured to the upper end of an upright rotary steering post having a lower end extending into a chamber formed in said body and opening at said top surface; a cable transmission operatively connecting said lower end of said steering post and said rudder for swinging motion thereof when said member is rotated for steering of said sporting boat, said cable transmission comprising a cable winding sheave arrangement in said body chamber and a pair of cable lengths cooperating with said winding sheave arrangement and extending through cable passages formed longitudinally of said body on either side of said racks, one end of each of said cable lengths being connected to the sides of said flat rudder, rearwardly of said rudder swinging axis.

A preferred embodiment of the invention will now be described with reference to the appended drawings wherein.

The water sporting boat now to be described is made up of three major components: a surfboard 1, a propelling mechanism 3 and a steering mechanism 5.

Figure 3:
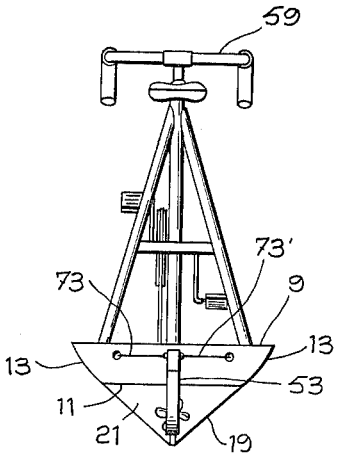
FIG. 3 is a rearview of the boat of FIG. 1.

The surfboard 1 is in the form of an elongated thin body 7 having a top surface 9, a bottom surface 11, surfaces 9 and 11 being interconnected by side surfaces 13, the latter curving inwardly downwardly between surfaces 9 and 11, as best shown in FIG. 3. Surfaces 9, 11 and 13 join one another at one end of the body 7 to form a bow 15 and terminate, at the other end, into a stern 17. A keel 19 projects from the bottom surface and is removably mounted, in any known manner, on the body 7.

Figure 2:
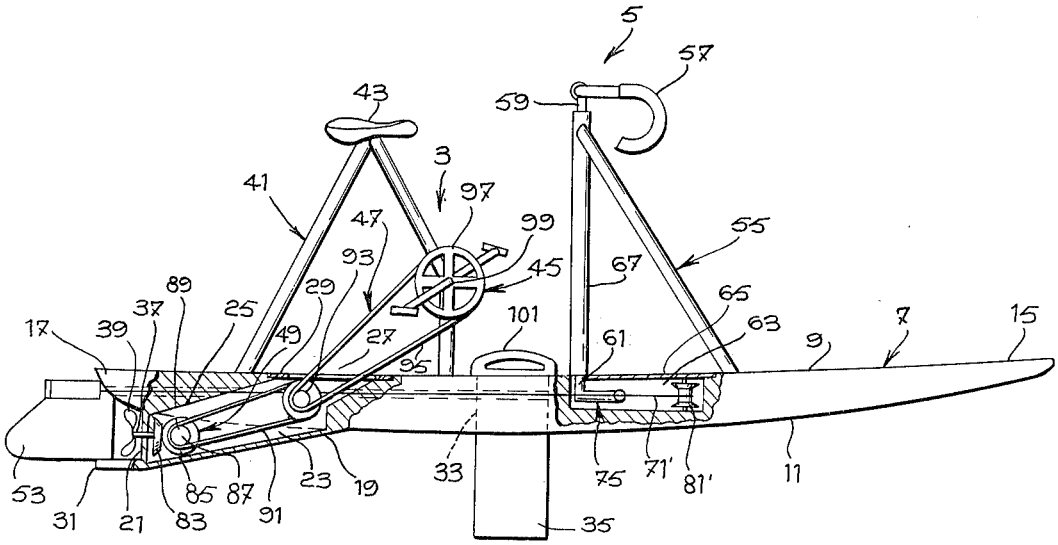
FIG. 2 is a side elevation of the boat of FIG. 1, portions being broken away to show some inner features.

The keel 19 has a vertical rear end wall 21 which is located short of the stern 17, transversely of the body 7. The keel 19 also includes confining outer walls which taper forwardly from the end wall 21 (FIG. 2) as well as laterally (FIG. 3) so that these confining walls merge smoothly with the body beneath its top surface 9.

It will also be noted that the keel 19 is hollowed out to define a keel chamber 23 (FIG. 2), a passage 25 through the body 7 opening into the chamber 23 and onto the body top surface 9. This passage 25 enlarges, at its upper end, into a housing 27 having a top opening on the top surface 9 of the body 7. This opening is closed by a removable cover 29. Finally, the keel 19 has a rudder supporting ledge 31, made integrally therewith, which projects perpendicularly from the lower edge of the keel end wall 21 in the direction of the stern 17.

An elongated slot 33 is formed through the body 7, intermediate the bow 15 and the stern 17, for the removable and snugly insertion of a fin 35, the latter projecting from the bottom surface 11 sufficiently to provide, in use, adequate stability to the surfboard 1.

The propelling mechanism 3, aforesaid, is formed as follows. A rotary shaft 37 is mounted across the keel end wall 21 with one end located inside the keel chamber 23 while the other end lies outside the chamber. A propeller 39 is mounted on the outside end of the shaft 37. A sitting rack 41, secured in any known manner to the top surface 9 of the surfboard body 7, has a seat 43 at the top for a user. A pedalling mechanism 45 is mounted on the sitting rack 41 and includes a chain drive 47 that extends through the body passage 25 and its housing 27 and enters into the keel chamber 23. A mechanical transmission 49, in the keel chamber 23, operatively joins the chain drive 47 and the rotary shaft so that operation of the pedalling mechanism 45 causes rotation of the propeller 39 for displacement of the surfboard.

Figure 1:
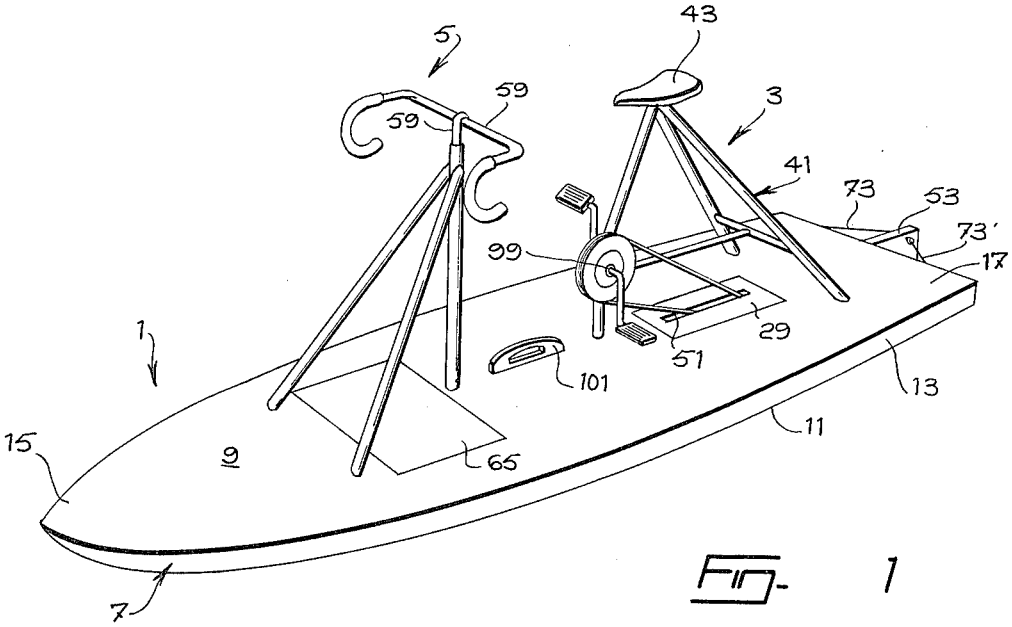
FIG. 1 is a perspective view of a water sporting boat having the features of the present invention.

As possibly best shown in FIG. 1, the sitting rack 41 is in the form of a tripod of which the legs have the lower ends disposed about the passage housing 27. It will be noted that the plate 29 is provided with a suitable elongated slot 51 for the passage of the top one of the chains of the chain drive 47, as will hereinafter be more fully described. As will be noted, the forward one of the legs of the tripod is formed, for constructional convenience, of two parts of which the one connected to the surfboard is vertical.

The steering mechanism 5 generally consists of the following components.

Figure 4:
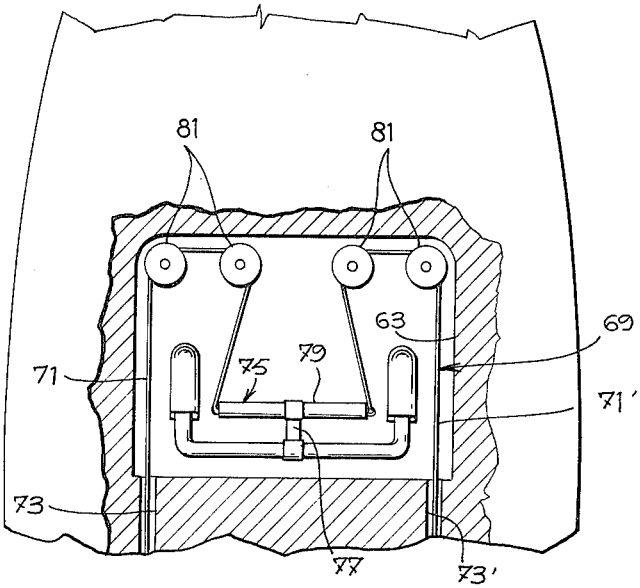
FIG. 4 is a top plan view of the mid-section of the boat of FIG. 1, again partially broken away to show some inner features.

An essentially flat rudder 53 (FIG. 2) having a rear vertical edge is mounted, in any known manner, on the rudder supporting ledge 31 and on the body stern 17 for swinging movement about a vertical axis extending across the free end of the ledge 31, along the rudder rear edge and across the stern 17. The rudder 53 is disposed rearwardly of the propeller 39. Forwardly of the sitting rack 41 is a steering rack 55 which is secured to the top surface 9 of the surboard body 7 and which includes a horizontal handle bar 57 fixed, at its center, to an upright rotary steering post 59 of which the lower end 61 extends into a steering chamber 63 formed in the body 7, chamber 63 being opened at the top and closed by a removable cover 65. As with the sitting rack 41, the steering rack 55 is a tripod of which the legs have their lower ends disposed about the steering chamber 63. One of the legs of this tripod is a vertical tube 67 into which the steering post 59 is rotatably mounted. A cable transmission 69 (FIG. 4), to be further described hereinafter, operatively connects the lower end 61 of the steering post 59 and the rudder 53 for swinging motion of the latter when the handle bar 57 is rotated so that steering of the supporting boat is made possible. As shown, the cable transmission 69 generally comprises a cable winding sheave arrangement in the body chamber 63 and a pair of cable lengths 71, 71' cooperating with the sheave arrangement and extending through cable passages 73, 73' formed longitudinally of the body 7 and on either side of the racks 41, 55, one end of each of the cable lengths 73, 73', being connected to one of the side faces of the flat rudder 53 as clearly illustrated in FIGS. 1 and 3, the connection being rearwardly of the rudder swinging axis. With this arrangement, it is ensured that the rudder 53 responds to the same steering direction as that applied by the handle bar 59. In other words, if the handle bar is rotated clockwise for rightward turning, the rudder 53 turns counterclockwise with respect to its rotation axis.

The cable transmission 69 further includes a T-shaped transmission lever generally denoted by numeral 75 and having a center bar 77 connected at its free end to the lower end 61 of the steering post 59 to extend perpendicularly therefrom toward the bow 15 and further having a cross bar 79. The cable winding sheave arrangement, on the other hand, comprises four sheaves 81 in two groups of two, sheaves located forwardly of the lever 75. The ends of the cable lengths 71, 71', opposed to those secured on either face of the rudder 53, are fixed at the free ends of the cross bar 79 of the transmission lever 75 after winding around the sheaves 81, as clearly illustrated in FIG. 4. The transmission lever 75 as well as the sheaves 81 are wholly contained in the steering chamber 63.

Returning now to the mechanical transmission 49, it is made up of a first bevel gear 83 secured on the chamber end of the propeller rotary shaft 37. A second bevel gear 85 meshes with this first bevel gear 83 and is secured on an axle 87 which is mounted across the keel chamber 23. As to the chain drive 47, mentioned above, it comprises a first pinion 89 secured on the axle 87 and a first chain 91 which winds around the first pinion 89 so that its movement causes rotation of the propeller 39 through the mechanical transmission 49.

The chain drive 47 further comprises an additional axle (not shown) journalled in a pair of bearings 93 each provided on one side of the passage 25 which opens into the housing 27. Secure on this additional shaft are a second pinion and a first sprocket wheel around which winds a second chain 95 which further winds on a second sprocket wheel 97 mounted on a rotary crankshaft 99 mounted for rotation on the forward leg of the sitting rack 41. The cranks of this shaft 99 are of course provided with the usual pedals. From this description, it is seen that the first drive chain 91 meshes both with the first pinion 89 and the first sprocket wheel while the second drive chain 95 meshes both with the second pinion and the second sprocket wheel 97.

It can of course be easily realized that the central pinion and the sprocket wheel arrangement of the chain drive 47 may be dispensed with, the second chain 95 then being directly connected to the first pinion 89 mounted on the axle 87 of the mechanical transmission 49.

Referring again to FIG. 2, it will be seen that the stabilizing fin 35 is located between the sitting rack 43 and the steering rack 55 and that it comprises a handle 101, at its top, which protrudes laterally of the side faces of the fin 35 whereby to form abutting shoulders that sit on the body top surface 9 to prevent the fin 35 from falling through the slot 33.

Finally, cover 29 of housing 27 as well as cover 65 of chamber 63 have their top faces lying flush with the body top surface 9 and both lie within the confine defined by the lower legs of their respective tripods.

I claim:

1. A water sporting boat of the pedal type, comprising:

a surfboard in the form of an elongated thin body having top and bottom surfaces interconnected by side surfaces, said surfaces terminating at one end of said body to form a bow and terminating, at the other end of said body, into a stern; a keel projecting from said bottom surface and removably mounted on said body; wherein said keel has a vertical end wall located short of said stern transversely of said body, and further has confining outer walls tapering forwardly from said end wall and smoothly merging with said body beneath said top surface; said keel being hollowed out to define a keel chamber; a passage opening into said chamber and onto said body top surface; a rudder supporting ledge integral with said keel, projecting perpendicularly from the lower edge of said keel end wall in the direction of said stern; an elongated slot formed through said body, intermediate said bow and stern, and a fin removbly and snugly passing across said slot from said body top surface and extending away from said body bottom surface sufficiently to ensure stability to said surfboard, in use thereof;

a propelling mechanism comprising: a rotary shaft mounted across said keel end wall, having one end inside said keel chamber and one end outside thereof; a propeller mounted on said outside end; a sitting rack secured to the top surface of said surfboard body and having a seat for a user at the top thereof; a pedalling mechanism mounted on said sitting rack and including a chain drive extending through said body passage and into said keel chamber, and a mechanical transmission in said chamber, operatively joining said chain drive and aid rotary shaft, whereby operation of said pedalling mechanism causes rotation of said propeller for displacement of said surfboard;

a steering mechanism comprising: an essentially flat rudder having a rear vertical edge and mounted on said rudder supporting ledge and on said body stern for swinging movement about a vertical axis extending across the free end of said ledge, across said stern and along said rudder rear edge, rearwardly of said propeller; a steering rack secured to the top surface of said surfboard body, forwardly of said sitting rack, and including a steering member secured to the upper end of an upright rotary steering post having a lower end extending into a chamber formed in said body and opening at said top surface; a cable transmission operatively connecting said lower end of said steering post and said rudder for swinging motion thereof when said member is rotated for steering of said sporting boat, said cable transmission comprising a cable winding sheave arrangement in said body chamber and a pair of cable lengths cooperating with said winding sheave arrangement and extending through cable passages formed longitudinally of said body on either side of said racks, one end of each of said cable lengths being connected to the sides of said flat rudder, rearwardly of said rudder swinging axis.

2. A boat according to claim 1, wherein said stabilizing fin is provided between said sitting rack and said steering rack.

3. A boat as claimed in claim 2, wherein said stabilizing fin comprises a handle, at the top thereof, protruding laterally of the side faces of said fin to form abutting shoulders sitting on said body top surface to prevent said fin from sliding through said slot.

4. A boat as claimed in claim 1, wherein said body side surfaces curve inwardly downwardly between said body top surface and said body bottom surface.

5. A boat as claimed in claim 1, wherein said mechanical transmission comprises: a first bevel gear secured at the chamber end of said propeller rotary shaft; a second bevel gear in mesh with said first bevel gear and an axle mounted across said keel chamber, said second bevel gear being secured on said axle, and wherein said chain drive comprises a first pinion secure on said axle and a first chain winding around said first pinion to cause rotation of said propeller through said mechanical transmission.

6. A boat as claimed in claim 5, wherein said chain drive passage enlarges at its upper end into a housing opening on said body top surface and said chain drive further comprises: a further axle mounted across said housing; a second pinion and a first sprocket wheel secured to said further axle; a rotary crankshaft on said sitting rack having a second sprocket wheel secured thereto; wherein said first drive chain meshes both with said first pinion and first sprocket wheel, and a second drive chain meshing both with said second pinion and said second sprocket wheel.

7. A boat as claimed in claim 6, wherein said sitting rack is a tripod of which the legs have the lower ends thereof disposed about said chain drive passage housing.

8. A boat as claimed in claim 6, wherein said cable transmission further comprises: a T-shaped transmission lever having a center bar connected at the free end thereof to the lower end of said steering post to extend perpendicularly therefrom toward said bow and having a cross bar; said cable winding sheave arrangement comprising sheaves mounted on said body forwardly of said lever, and wherein said other ends of said cable length are secured at the free ends of said cross bar after winding around said sheaves from said rudder, each cable length being located solely on one side of said steering post; said transmission lever and sheaves being wholly contained in said body chamber.

9. A boat as claimed in claim 6, wherein said steering rack is a tripod of which the legs have the lower ends thereof disposed about said body chamber.

10. A boat as claimed in claim 9, wherein one leg of said steering rack tripod is a tube into which said steering post is journalled.

11. A boat as claimed in claim 6, further comprising a cover removably closing said body chamber and having a top face lying flush with said body top surface.

12. A boat as claimed in claim 6, further comprising a cover closing said chain drive passage housing and having a top face lying flush with said body top surface.

13. A boat as claimed in claim 12, wherein said sitting rack is a tripod of which the legs have the lower ends thereof disposed around said chain drive passage housing and wherein said housing and cover therefor lie within the confine defined by the lower ends of said tripod.

14. A boat as claimed in claim 1, wherein said cable transmission further comprises: a T-shaped transmission lever having a center bar connected at the free end thereof to the lower end of said steering post to extend perpendicularly therefrom toward said bow and having a cross bar; said cable winding sheave arrangement comprising sheaves mounted on said body forwardly of said lever, and wherein said other ends of said cable lengths are secured at the free ends of said cross bar after winding around said sheaves from said rudder, each cable length being located solely on one side of said steering post; said transmission lever and sheaves being wholly contained in said body chamber.

* * * * *